US009631405B2

(12) United States Patent
Könkler et al.

(10) Patent No.: US 9,631,405 B2
(45) Date of Patent: Apr. 25, 2017

(54) SECURING MECHANISM FOR CLOSING A DOOR, IN PARTICULAR AN APPLIANCE

(75) Inventors: Michael Könkler, Heiligenhaus (DE); Rinaldo Pietrasch, Heiligenhaus (DE)

(73) Assignee: RAHRBACH GMBH, Heiligenhaus (DE)

( * ) Notice: Subject to any disclaimer, the term of this patent is extended or adjusted under 35 U.S.C. 154(b) by 322 days.

(21) Appl. No.: 14/233,153

(22) PCT Filed: Jul. 11, 2012

(86) PCT No.: PCT/DE2012/100210

§ 371 (c)(1),
(2), (4) Date: Jan. 15, 2014

(87) PCT Pub. No.: WO2013/010534

PCT Pub. Date: Jan. 24, 2013

(65) Prior Publication Data

US 2014/0159381 A1 Jun. 12, 2014

(30) Foreign Application Priority Data

Jul. 15, 2011 (DE) ..... 10 2011 051 884

(51) Int. Cl.
*E05C 19/10* (2006.01)
*E05C 3/06* (2006.01)
(Continued)

(52) U.S. Cl.
CPC ..... *E05C 19/00* (2013.01); *E05B 15/022* (2013.01); *E05B 47/0676* (2013.01);
(Continued)

(58) Field of Classification Search
CPC ..... Y10T 292/0814; Y10S 292/12; Y10S 292/69; E05B 15/022; E05B 17/20;
(Continued)

(56) References Cited

U.S. PATENT DOCUMENTS 1,309,310 A * 7/1919 Voight ..... B65F 1/1615 292/198
1,338,052 A * 4/1920 Voight ..... E05C 19/022 292/130
(Continued)

FOREIGN PATENT DOCUMENTS

DE 102009016812 10/2009
DE 102009016812 A1 * 10/2009 ..... E05B 17/0029
(Continued)

OTHER PUBLICATIONS

PCT, International Search Report; International Patent Application No. PCT/DE2012/100210 (Jan. 24, 2013).
(Continued)

*Primary Examiner* — Kristina Fulton
*Assistant Examiner* — Christine M Mills
(74) *Attorney, Agent, or Firm* — Thompson Hine LLP

(57) ABSTRACT

A securing mechanism for a door, especially the door of a device, comprising a first closure element; an arresting structure disposed on the first closure element; a second closure element configured for latching with the arresting structure, wherein for unlatching purposes, the second closure element is rotatable relative to the first closure element; and a lever support that is movable relative to the second closure element such that it is transferable between a release position, in which it cancels a latching of the second closure element with the arresting structure, and a latching position in which the latching of the second closure element with the arresting structure is maintained. The lever support is also movable relative to the first closure element.

20 Claims, 10 Drawing Sheets

(51) Int. Cl.

| | |
|---|---|
| ***E05C 19/00*** | (2006.01) |
| ***E05B 15/02*** | (2006.01) |
| ***E05B 47/06*** | (2006.01) |
| ***E05B 63/24*** | (2006.01) |
| ***E05C 5/00*** | (2006.01) |

(52) U.S. Cl.
CPC ..... *E05B 63/248* (2013.01); *E05C 5/00* (2013.01); *E05B 2015/0235* (2013.01); *Y10S 292/69* (2013.01); *Y10T 292/0814* (2015.04)

(58) Field of Classification Search
CPC ..... E05B 17/2007; E05B 63/248; E05B 2015/0235; E05B 47/0676; E05C 3/40; E05C 19/00; E05C 5/00
USPC ..... 292/14, 70, 77, 99, 195, 198, 336.3, 23, 292/347, 348, DIG. 12, DIG. 69
See application file for complete search history.

(56) References Cited

U.S. PATENT DOCUMENTS

| | | | | | |
|---|---|---|---|---|---|
| 2,872,241 | A * | 2/1959 | Shelden | B60N 2/20 | 292/198 |
| 3,011,816 | A * | 12/1961 | Van Noord | E05B 17/22 | 134/58 R |
| 3,733,456 | A * | 5/1973 | Blackburn | H05B 6/6417 | 219/719 |
| 4,082,078 | A * | 4/1978 | Thuleen | F24C 15/022 | 126/19 R |
| 4,159,837 | A * | 7/1979 | Morita | E05C 17/50 | 16/85 |
| 4,302,864 | A * | 12/1981 | Morita | E05C 17/50 | 16/85 |
| 4,982,063 | A * | 1/1991 | Tsunekawa | E05B 17/22 | 126/197 |
| 6,357,803 | B1 * | 3/2002 | Lorek | E05C 19/022 | 292/124 |

FOREIGN PATENT DOCUMENTS

| | | | | |
|---|---|---|---|---|
| DE | 102009017246 | | 10/2009 | |
| DE | 102009017246 | A1 * | 10/2009 | E05B 15/022 |
| DE | 102009014233 | | 6/2010 | |
| DE | 102009014233 | A1 * | 6/2010 | E05B 47/023 |
| DE | 102010007952 | | 2/2011 | |
| DE | 102010007952 | A1 * | 2/2011 | E05B 63/24 |
| DE | 102010032742 | | 5/2011 | |
| EP | 1111175 | | 6/2001 | |
| FR | EP 1191174 | A1 * | 3/2002 | E05C 17/14 |
| MC | EP 0003350 | A1 * | 8/1979 | A47L 15/4409 |

OTHER PUBLICATIONS

PCT, Written Opinion; International Patent Application No. PCT/DE2012/100210 (Jan. 15, 2014).

PCT, International Preliminary Report on Patentability; International Patent Application No. PCT/DE2012/100210 (Jan. 21, 2014).

* cited by examiner

SECURING MECHANISM FOR CLOSING A DOOR, IN PARTICULAR AN APPLIANCE

The instant application should be granted the priority dates of Jul. 15, 2011, the filing date of the corresponding German patent application 10 2011 051 884.3, as well as Jul. 11, 2012, the filing date of the International patent application PCT/DE2012/100210.

BACKGROUND OF THE INVENTION

The present invention relates to a closure, securing mechanism, or lock for closing or locking a door, in particular a door of an appliance or device, and includes a second closure element that can be latched with an arresting structure of a first closure element, and that for unlatching purposes is rotatable relative to the first closure element, and also includes at least one lever support that is disposed so as to be movable relative to the second closure element, wherein the lever support is transferrable between a release position, in which as a consequence of a relative rotation the lever support cancels the latching on the arresting structure, and into a latching position in which, during a relative rotation, the latching on the arresting structure is maintained.

Such door closures are used for closing or locking many different types of equipment or appliances such as, for example, cooking devices, eating devices, refrigerators, cooling cabinets, etc., and are customarily composed of two closure elements, one of which is connected with the door panel of the appliance door, and the other of which is connected with the sash or frame of the appliance door or with the housing of the appliance.

A closure is known from EP 1 111 175 A1, according to which the closure element that is connected with the door panel is embodied as a resilient clip or bracket that can be latched on an arresting structure of a closure element that is secured to the housing and is embodied as a locking pin. When the doors close, the two closure elements are acted upon by a closure force via a rubber-elastic seal that is provided between the door panel and the door sash and that seals off the interior of the appliance. To release the latching, and hence for opening the door, the two closure elements are rotated relative to one another by means of an actuating handle. Although such closures have in the past proven themselves, they generally, however, do not permit control of access by means of which in certain conditions, for example during an automatically running cleaning process taking place in the interior of the appliance, the closure could be blocked from being released, so that in such situations the door could not be opened.

DE 10 2009 016 812 A1 discloses a similar door closure having access control. In order in certain situations to prevent opening of the door, a sleeve-like slotted piece is rotatably disposed on the pin-shaped closure element. In the region of the arresting structure, the slotted piece is provided with a radially outwardly directed, eccentric surface, so that by rotating the slotted piece the undercut formed by the arresting structure can if necessary be enlarged for the purpose of access control. After rotation of the slotted piece has been completed, a release of the bracket-like closure element, even upon actuation of the handle, is no longer possible due to the undercut that extends over a greater angular range. However, a drawback of this type of access control is that it requires a relatively complicated structural configuration. In addition, the surface of the slotted piece is disposed in the region of the arresting structure between the two closure elements that, when the door is closed, are tensioned relative to one another via a rubber-elastic door seal. With every rotational movement of the slotted piece, it is therefore necessary to overcome the corresponding closing force, for which reason relatively strong drive means must be utilized for rotating the slotted piece.

A further closure having access control is known from DE 10 2009 014 233 A1, where, for purposes of access control, a lever support is provided that is movable back and forth between a release position and a locking position. In normal operation, the lever support is in the release position, in which as a result of a relative rotation of the two closure elements, the lever support levers the closure element, which is embodied as a resilient bracket, against the force of a spring and out of the arresting structure of the other closure element. In this manner, the latching or locking is released by actuating the actuation handle disposed on the door handle, and the appliance door can be opened. For purposes of access control, the lever support can be moved out of the release position into a locking position in which it does not lever the resilient bracket out of the arresting structure, even upon actuation of the actuating handle. The lever support is integrally formed on the closure pin, which is fixed to the housing, in the manner of a radial widened portion. To move the lever support, the closure pin is rotatably mounted on the housing of the appliance via a drive provided for that purpose. If access to the interior of the appliance is now to be blocked due to a cleaning process taking place therein, by means of the drive the closure pin, and therewith the lever support, are moved relative to the resilient bracket into a position in which the resilient bracket can no longer be levered out of the arresting structure by means of actuation of the actuation handle.

This closure also has the drawback that for levering out the resilient closure element the lever support is integrally disposed on the closure element that is fixed to the housing, so that for the movement of the lever support, the first closure element must be moved counter to the closing force that is present between the two closure elements. Also with this closure it is therefore necessary to have a relatively strong drive for rotating the pin-shaped closure element.

It is an object of the present invention to provide a structurally straightforward closure having access control, with which it is also possible to utilize low-power drives.

SUMMARY OF THE INVENTION

This object is realized for a closure of the aforementioned general type in that the lever support is also movable relative to the first closure element.

Due to the relatively movable arrangement of the lever support relative to both of the closure elements, it can be easily moved back and forth between the release position and the latching position, and, for the purpose of access control it is also possible to be able to use low-power drives. It is not necessary to move one of the closure elements or the lever support against the closing force that exists between the closure elements. A structurally straightforward configuration having a drive mechanism that requires little power results.

Pursuant to one structurally advantageous further development of the invention, the lever support can be moved between the release position and the latching position by means of an actuation element, whereby in this connection, pursuant to a further embodiment of the invention, it is particularly advantageous if the actuation element is motor driven, in particular by an electric motor. The actuation element can be guided into that region of the securing mechanism that is visible when the door is opened, and the drive mechanism of the actuation element can be disposed in the interior of the housing of the device where it is protected from contamination, spray water, etc. Pursuant to one structurally straightforward configuration, the support lever can be provided directly on the actuation element; for example, the actuation element can be an axially movable rod, the outer surface of which forms the lever support for the canceling or levering out of the latching.

It is further proposed pursuant to another embodiment of the invention that the lever support be disposed on a pivot element that is pivotable by the actuation element. By means of the interposition of at least one pivot element, the actuation element can be disposed at a greater spacing relative to the two closure elements, and the lever support can be brought into its release or latching position by means of the pivot element.

In this connection, pursuant to one structurally advantageous further development, the pivot element can be pressed into the release position, and arrested in this position, by means of the actuation element. With such a configuration, the actuation element has a double function. On the one hand, the actuation element is embodied as a type of slide element in such a way that the lever support disposed on the pivot element is movable into its release position by the application of pressure. On the other hand, the actuation element functions as a type of securement element of the lever support in its release position. The actuation element can be embodied in such a way that with a relative rotation of the closure elements, it absorbs forces that act upon the lever support without the lever support being moved out of its release position. To this extent, the actuation element forms a blocking of pivoting of the pivot element into the release position of the lever support.

Pursuant to a further embodiment, the pivot element is freely pivotable after the actuation element is moved back. After the actuation element is pulled back, the pivot element, due to its freely pivotable configuration, can easily pivot back and bring the lever support into its latching position. In this connection, it is furthermore advantageous if the pivot element is configured in such a way that after removal of the actuation element it moves into the latching position as a consequence of its own weight.

Pursuant to one structurally advantageous further development of the pivot element, the latter is configured as a swiveling detent, by means of which a change in direction of the movement direction prescribed by the actuation element can be achieved. The swiveling detent is advantageously angularly configured, with the legs thereof extending at an angle relative to one another and in an intermediate region defining the pivot axis of the pivot element. In this connection, it is furthermore advantageous if the pivot element is configured and arranged in such a way that that leg that cooperates with the actuation element extends essentially vertically in the release position, while the other leg is angled off relative thereto. As a result of the vertical orientation of the leg that cooperates with the actuation element, a favorable support of the lever support in the release position is achieved. Due to the fact that the other leg extends at an angle thereto, during removal of the actuation element the pivot element assumes an unstable position. Due to the weight of the angled-off leg, there results a tilting moment which leads to a pivoting back of the lever support into its latching position initiated by its own weight.

To accomplish a double latching possibility, it can be advantageous in this connection if the pivot element is configured as a double swiveling detent having lever supports that can be disposed on both sides thereof. As a result of the double-sided arrangement of two lever supports, relative rotations of the two closure elements in both directions, in other words not only a left rotation but also a right rotation, can be utilized to lever the second closure element out over the respective lever support.

With regard to a compact construction that requires few parts, it is proposed in a further embodiment that the pivot element be pivotably movably disposed on the first closure element. The first closure element can be utilized as a pivot mounting of the pivot element.

Pursuant to a further embodiment, the pivot axis of the pivot element can extend parallel to the direction of the arresting structure, and in particular horizontally. Pursuant to one structural configuration, it is further proposed that the pivot element be disposed on a side surface of the first closure element.

Pursuant to an alternative configuration, the pivot axis of the pivot element can extend transverse to the direction of the arresting structure, and in particular, vertically. With such a configuration, the pivot element can be disposed on an underside or upper side of the closure element.

As an alternative configuration, it is proposed that the lever support be disposed on a slide element that is displaceable by means of the actuation element. Also with the interposition of a slide element, the actuation element can be disposed at a greater distance relative to the closure elements, and the lever support can be brought into its release or latching position by means of the slide element.

In this connection, it is further proposed that the slide element can be pressed into the release position, and arrested in this position, via the actuation element. By means of the actuation element, the slide element, and the lever support disposed thereon, can be moved into the release position by applying pressure. Furthermore, the actuation element holds the lever support in its release position.

Pursuant to one structurally advantageous configuration of the slide element, the latter is biased in the direction of the latching position of the lever support by means of a spring. The spring can be disposed in such a way that during movement of the slide element into the release position the spring is tensioned, and after withdrawal of the actuation element, the slide element automatically moves into its latching position.

Pursuant to an alternative configuration, the actuation element is coupled with the slide element in a pressing and pulling manner. By means of the pressure coupling, the slide element can be displaced into the release position. By means of the pulling coupling, during retraction of the slide element the slide element can be carried along and can in this manner bring the lever support into the latching position.

Pursuant to a structural further development it is proposed that the slide element be disposed on the first closure element so as to be axially movable. Thus, the first closure element also serves to accommodate the slide element, so that no separate accommodation or receiving means is required, resulting in a fewer number of parts.

In this connection, for a defined movement sequence, it is advantageous if the movements of the slide element are guided via an axial guide, such as a pin/slot guide. In particular, the pin can be disposed on the first closure element, and the slot can be disposed on the slide element such that it is movable relative to the pin.

To provide a double release possibility, pursuant to a further embodiment the slide element can be provided with a respective lever support on both sides of the first closure element. As a consequence of the double-sided arrangement of lever supports, relative movements of the closure elements in both directions, in other words not only left rotations but also right rotations, can be utilized to lever the second closure element over the respective lever support.

With respect to a user-friendly construction, it is furthermore proposed that the second closure element be configured so as to be rotatable via an actuation handle, and that the first closure element be stationary. The actuation handle can be disposed on a pivotable actuation lever that can be deflected toward both sides in a prescribed angular range of, for example, 45° out of a preferably vertical index position. In this connection, it is further proposed that the actuation handle be acted upon with a spring force in such a way that it tends to always pivot back into its index position.

It is furthermore proposed that the first closure element be embodied as a locking or closing pin, and that the actuation element extend parallel to the axis of the locking pin.

Finally, with respect to an embodiment that permits an automatic release of the latching, it is proposed that the lever support be movable from the release position into an open position in which the latching on the resting structure is cancelled independently of the rotational position of the closure elements. By moving the lever support into its open position, the door is automatically opened. By means of the lever support, the second closure element is raised to such an extent that the latching on the arresting structure is canceled or released, and the door springs open at least to a gap under the influence of the closure force applied via the door seal. A transfer of the lever support into its open position can in particular in the framework of cooking or baking processes be effected upon reaching a preset point in time, so that, for example after a preset time of fifteen minutes, the door opens without the user having to personally monitor these times and having to manually open the device.

BRIEF DESCRIPTION OF THE DRAWINGS

Further details and advantages of one inventive securing mechanism will be explained subsequently with the aid of the accompanying drawings of exemplary embodiments, in which.

DESCRIPTION OF SPECIFIC EMBODIMENTS

Figure 1:
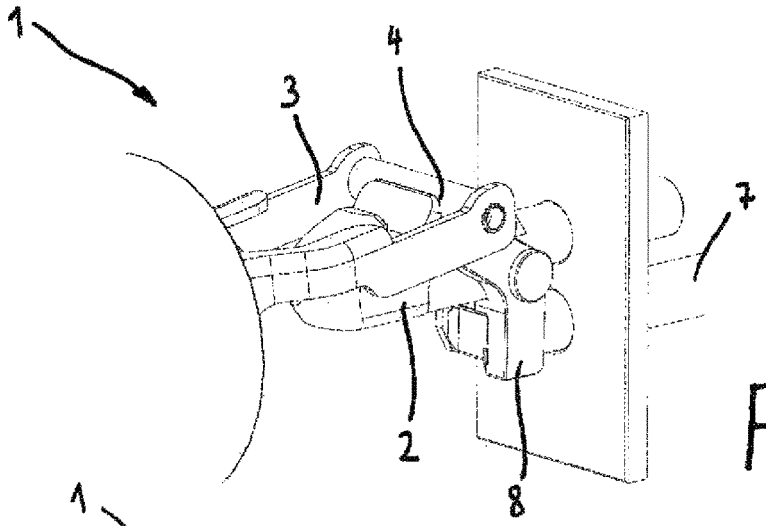
FIGS. 1-3 show one embodiment of a securing mechanism in a first position, whereby the lever support is disposed in its locking position.

FIG. 1 illustrates the closure, securing mechanism, or lock 1 of a door, for example the door of a heating device used in a kitchen or cooking area, in the locked or latched state. The essential components of the securing mechanism 1 are at least one first closure element 2 and at least one second closure element 3, which can be latched together via at least one locking or arresting structure 4 that is disposed on the first closure element 2.

To facilitate illustration, details of the device, i.e. of the door disposed thereon, are not illustrated in the drawings.

With the exemplary embodiments illustrated in the drawings, the individual components of the securing mechanism 1 are disposed in such a way that the first closure element 2 is fixedly secured on a door frame or the housing of the device. The second closure element 3 is disposed on the door panel, and can be moved relative to the stationary first closure element 2 in such a way that it follows the movement of the door panel during opening or closing of the door. However, alternatively, it would also be conceivable to dispose the first closure element 2 on the door panel, and the second closure element 3 on the housing.

Figure 2:
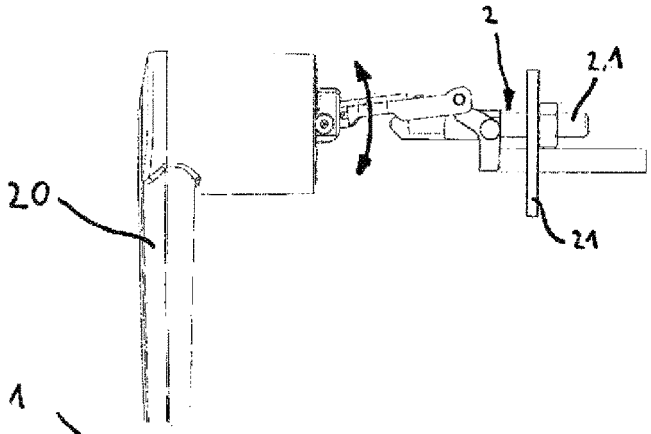
Figure 3:
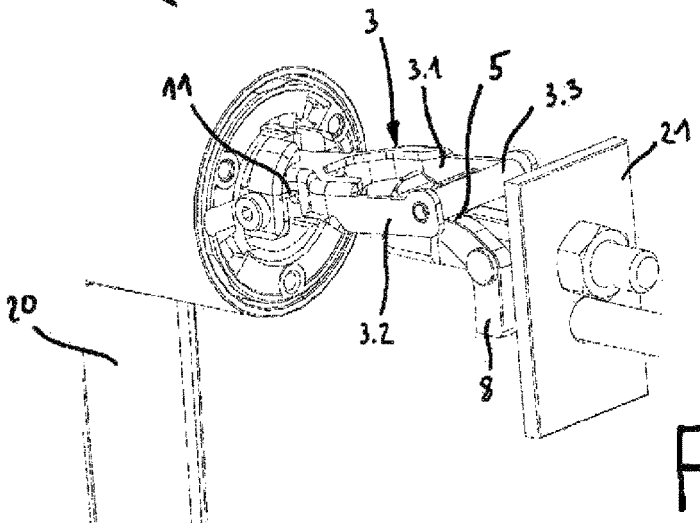

As can be seen in particular from the illustration in FIG. 3, the second closure element 3 that is disposed on the door is configured in the manner of a spring-loaded U-shaped member having two legs 3.1, 3.2 as well as a latching portion 3.3 that extends transverse to the legs 3.1, 3.2, and that is embodied in a manner of a cross bolt. To reduce the friction during latching of the first closure element 2 with the second closure element 3, the latching portion 3.3 is provided with a roller that is rotatably mounted thereon, as a result of which wear of the two closure elements 2,3 caused by friction can be reduced. On the whole, the second closure element 3 has a frame-like geometry and is rotatably coupled with a pivotable actuation handle 20, which is accessible from the outside of the door that is to be locked or latched. During deflection of the handle 20, the closure element 3 therefore follows its rotational movement, and is rotated relative to the first closure element 2. Within the handle 20, the second closure element 3 is pivotably coupled with the handle 20 against the force of a return spring 11 in the direction indicated in FIG. 2 by the double-headed arrow. In this connection, the force of the return spring 11 is directed such that the closure element 3 always tends to assume an essentially horizontal position.

The first closure element 2 is configured in the manner of an elongated locking or closing pin and extends in the direction of the closure element 3 that is disposed on the door. The closure element 2 has a pin-like geometry, and is fixed via a threaded portion 2.1 in an opening of the device housing 21; see in particular FIG. 7. In the direction of the door, i.e. of the second closure element 3, the closure element 2 is provided with an inclined portion 2.2 as well as two locking or arresting structures 4,6 that are configured in the manner of undercuts and on which the latching portion 3.3 of the second closure element 3 can engage or latch.

The processes during the latching of the second closure element 3 on the first closure element 2 will subsequently first be explained before explaining the unlocking or unlatching process and details of the lever support 5.

During the latching process, the door panel, and with it the second closure element 3, approaches the stationary closure element 2. In this connection, the closure element 3 is initially disposed in an essentially horizontal position until it engages the free end of the first closure element 2, which is disposed at approximately the same level and is configured as a closing pin. In so doing, the latching portion 3.3 of the closure element 3 comes to rest against the inclined portion 2.2 of the first closure element 2, whereby during further closing of the door panel, this inclined portion acts as a sort of lifting incline. As a result, the roller provided in the latching portion 3.3 of the second closure element 3 begins to roll on the inclined portion 2.2 of the first closure element 2, and the second closure element 3, against the force of the spring 11 provided on the actuation handle 20, begins to pivot upwardly out of its horizontal position.

In the next step, the latching portion 3.3 of the second closure element 3 enters the forward arresting structure 6 of the first closure element 2. Under the influence of the spring 11, the closure element 3 springs downwardly into the arresting structure 6 before during further closing of the door panel it then encounters a second inclined portion 2.3, is again raised by means of this inclined portion, and finally latches or engages in the arresting structure 4 under spring force. Having arrived in this position, the door is closed, and the device can be used, for example, for cooking food.

In order to be able to manually release the latching established in this manner between the closure elements 2, 3, it is necessary to rotate the closure elements 2, 3 relative to one another. With the illustrated embodiments, the second closure element 3 is pivoted relative to the stationary first closure element 2 by actuating the handle 20, as a result of which the latching portion 3.3 is pivoted relative to the first closure element 2 on the periphery thereof and thus also relative to the locking or arresting structures 4,6. For this purpose, the handle 20 can be pivoted toward the right or toward the left in an angular range of 45°, starting from an essentially vertical index position.

Figure 4:
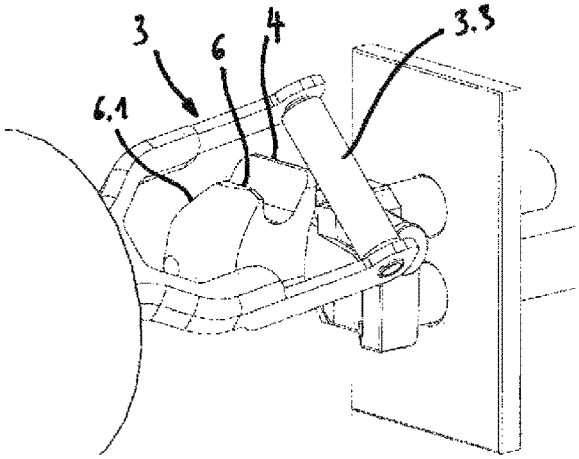
FIGS. 4-6 show the securing mechanism of FIGS. 1 to 3 in a second position, whereby the lever support is disposed in its release position.
Figure 5:
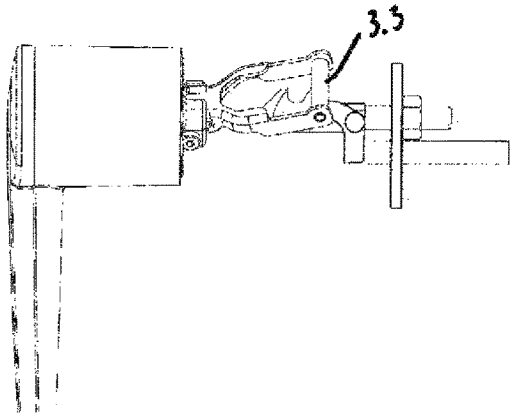
Figure 6:
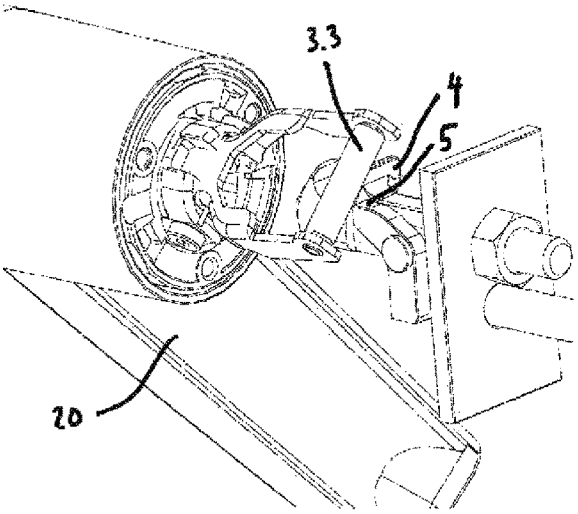

If the handle 20 is pivoted to the left, the latching portion 3.3 of the second closure element 3 pivots toward the right and strikes the lever support 5, which is disposed on the side of the first closure element 2. The lever support 5 is disposed in the release position, so that the latching portion 3.3 of the second closure element 3, starting from the position illustrated in FIGS. 1 to 3, is moved or levered via the lever support 5, in a sort of laterally offset tilting movement, into the position illustrated in FIGS. 4 to 6, in which the closure element 3, by means of a pulling back of the door panel, is guided over the arresting structure 4 and in this manner can release the latching on the arresting structure 4.

In its release position, the lever support 5 forms a type of tilt edge, which ensures that the second closure element 3 does not rotate about the axis of rotation of the handle 20, but rather is levered out in the manner of a tilt movement over the lever support 5 that is disposed in a laterally offset manner relative to the axis of rotation of the handle 20. During the levering out movement, the second closure element 3 shifts or deflects upwardly against the force of the spring 11, as a result of which the rotational spacing between the two closure elements 2, 3 is increased, and the undercut of the arresting structure 4 can be overcome. By pulling on the door handle 20, the latching portion 3.3 of the second closure element 3 glides over and past the undercut 4.

In the next step, the latching portion 3.3 encounters the arresting structure 6, which forms an intermediate latching stage, and again latches. The purpose of the intermediate latching is that the door does not initially open entirely; rather, only a defined opening gap is provided, in order, for example, to be able to let hot steam exit the device in a controlled manner. To release the intermediate latching, the handle 20 can be pivoted in the opposite direction of rotation, in other words toward the right, whereupon it can then be guided via a lateral cutout area that is provided on the second arresting structure 6, and the door can be completely opened; see in particular FIG. 4.

In order in certain situations to prevent access to the interior of the device, for example for safety reasons, to control access the lever support 5 is configured such that it can be removable from the rotational range of the two closure elements 2, 3. For this purpose, the lever support 5 is arranged so as to be freely movable, in a smooth-moving manner, relative to both closure elements 2, 3, which when the door is closed are secured against one another.

After removal of the lever support 5, a rotational movement of the second closure element 3 does not lead to a change in the spacing between the two closure elements 2, 3, so that the second closure element 3 cannot pass over the undercut of the arresting structure 4 of the first closure element 2, so that in this way the latching between the two closure elements cannot be released; see in particular FIGS. 9 to 14. In contrast to the arresting structure 6, the arresting structure 4 is configured in such a way that the rotational movements of the closure element 3 are not sufficient to release the latching portion 3.3 laterally from the arresting structure 4. To release the latching formed in the arresting structure 4, it is necessary to raise the latching portion 3.3 out of the arresting structure 4.

In order to be able to move the lever support 5 between the release position and the latching position, a motor-driven actuation element 7 is provided. The motor drive is not illustrated in the drawings, but, because of the easy movability of the lever support 5, which requires little force, can be relatively small, as a result of which a structurally favorable, economically advantageous construction can be realized.

In a structurally straightforward manner, the lever support 5 can be formed directly by the actuation element 7 or by an additional element that is moved by actuating the actuation element 7. In the exemplary embodiments of FIGS. 1 to 16, 23 and 24, the additional element is formed by a pivot element 8 that can be pivoted by the actuation element 7. In the embodiment of FIGS. 17 to 22, the additional element is formed by a slide element 9 that is displaceable by the actuation element 7, as will be described in detail subsequently.

Figure 7:
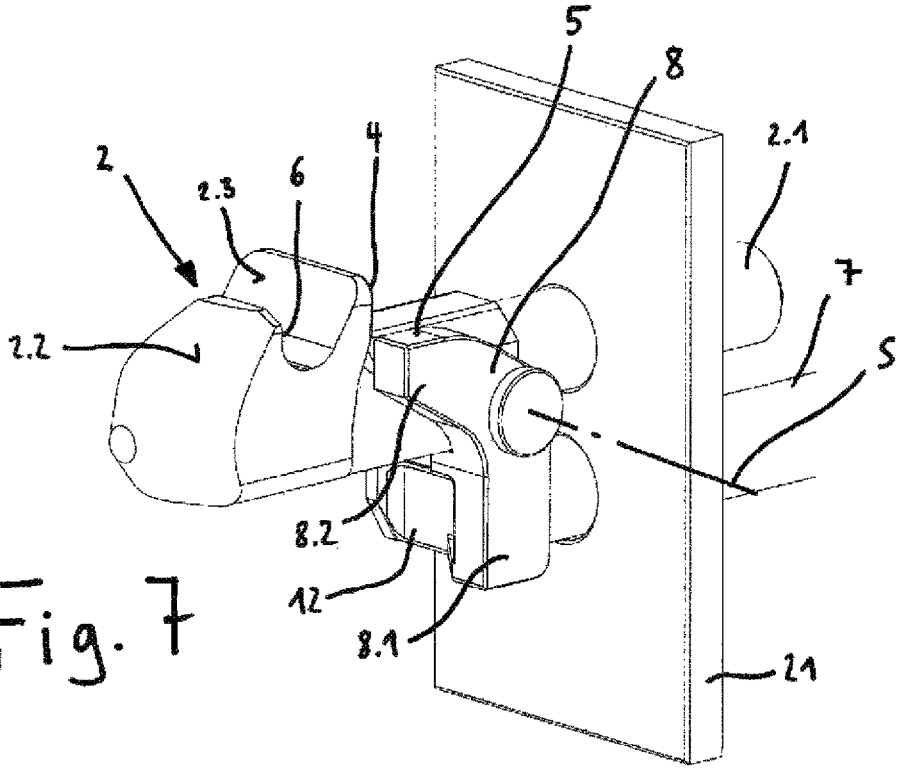
FIGS. 7 & 8 are perspective, enlarged detailed views.
Figure 8:
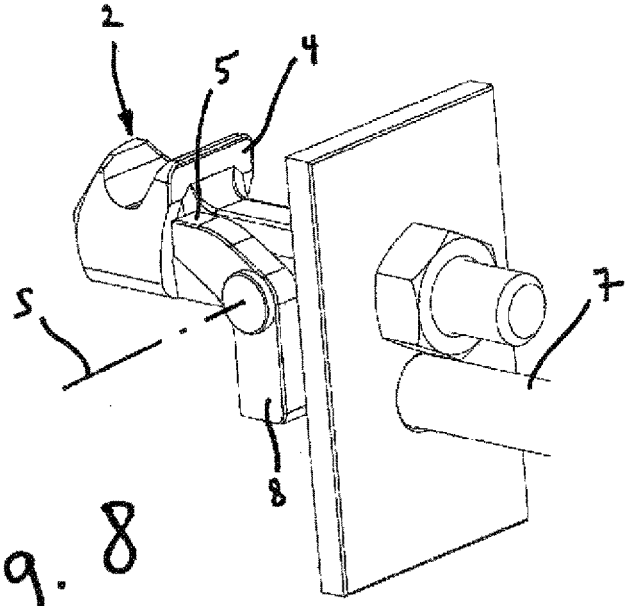
Figure 9:
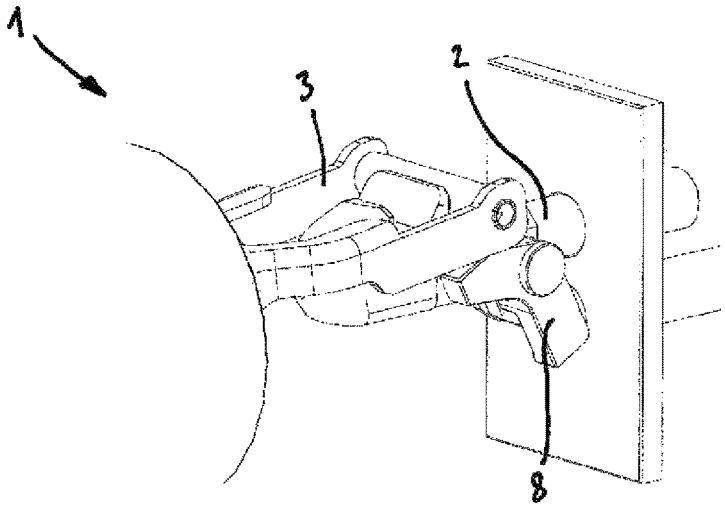
FIGS. 9-16 illustrate the securing mechanism of the illustrations of FIGS. 1 to 8, with the lever support being disposed in its latching position.
Figure 10:
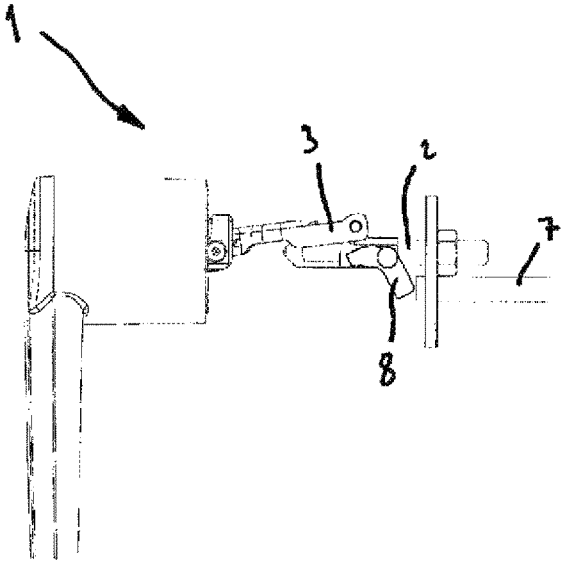
Figure 11:
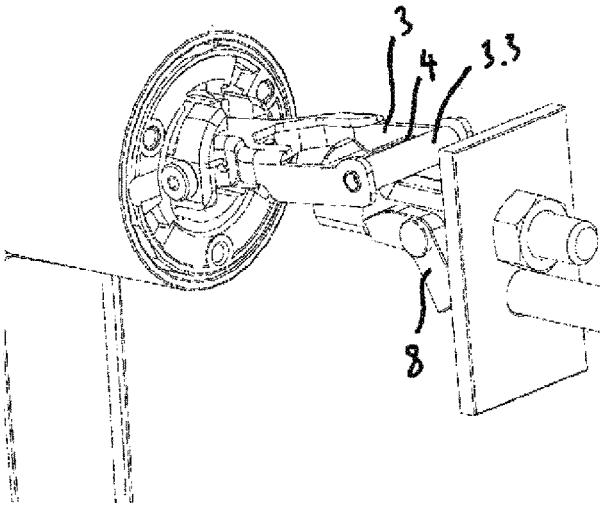
Figure 12:
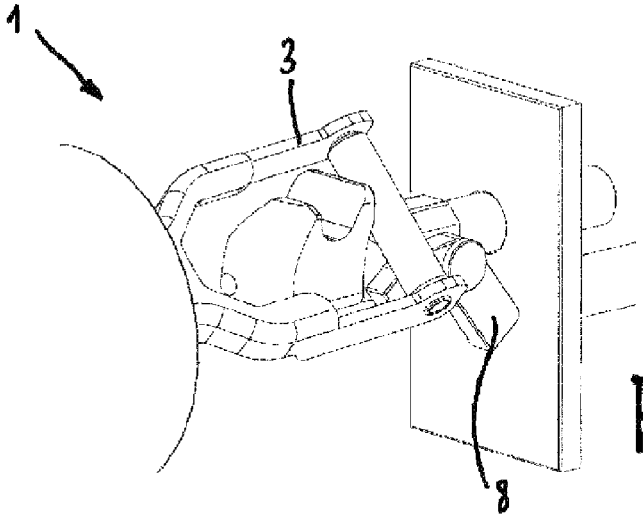
Figure 13:
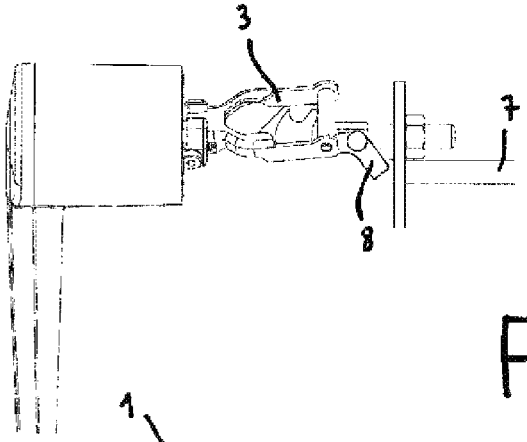
Figure 14:
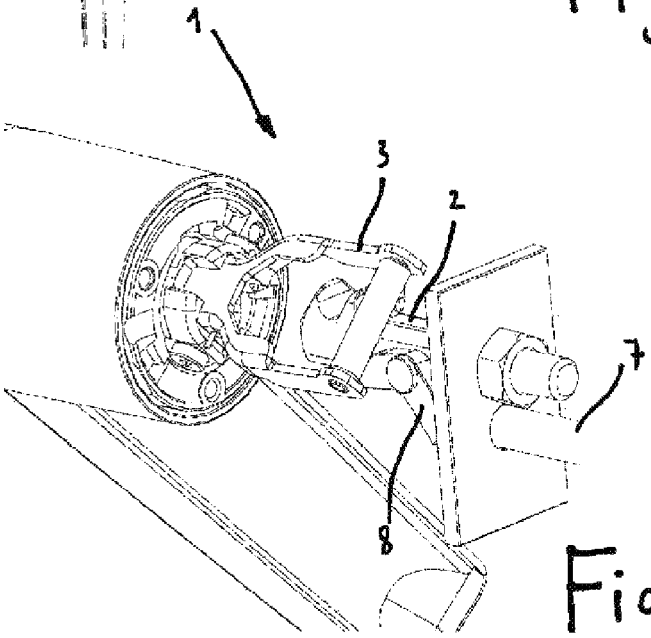
Figure 15:
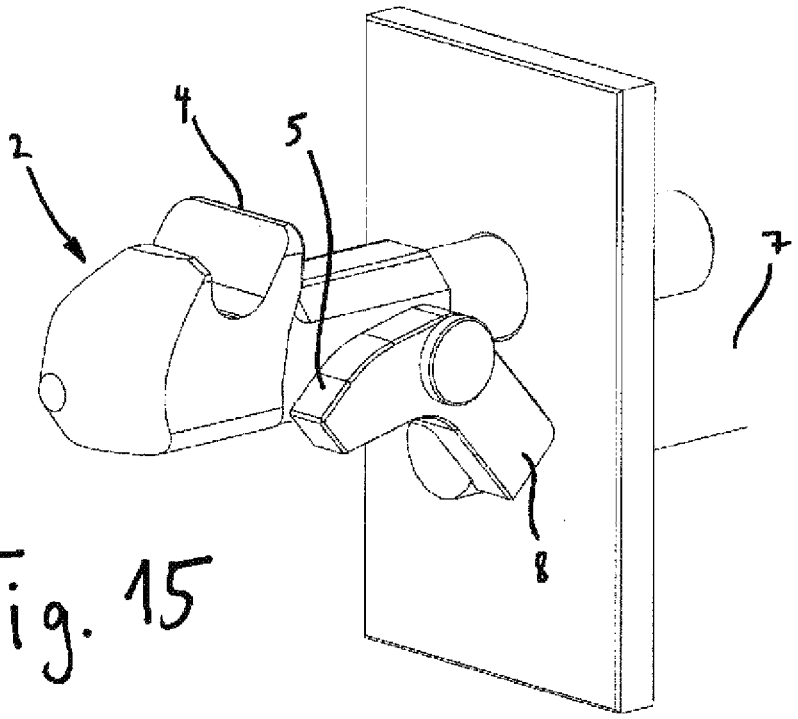
Figure 16:
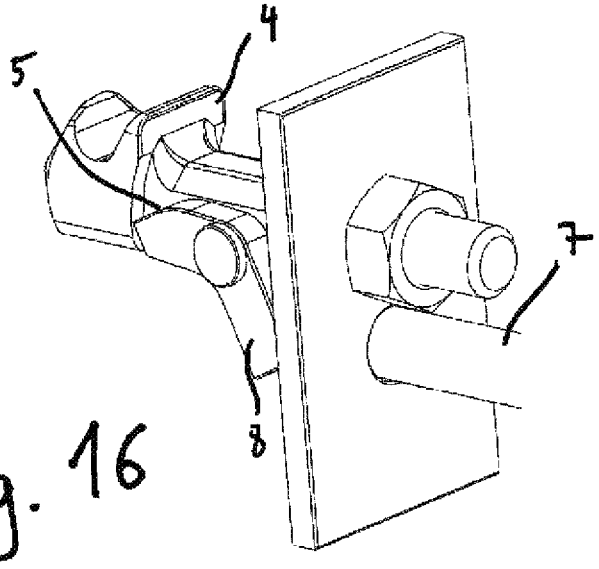
Figure 17:
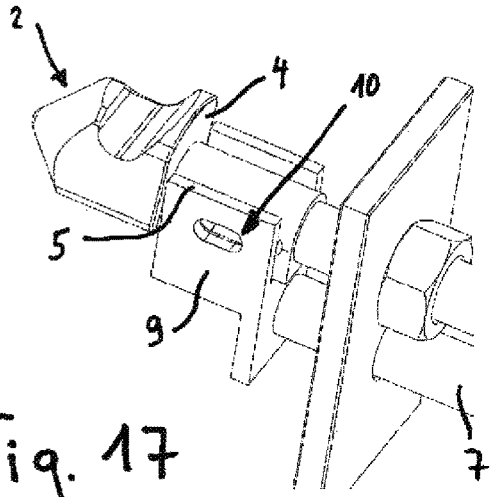
FIGS. 17-19 show a securing mechanism of a second exemplary embodiment, with the lever support being disposed in its release position.
Figure 18:
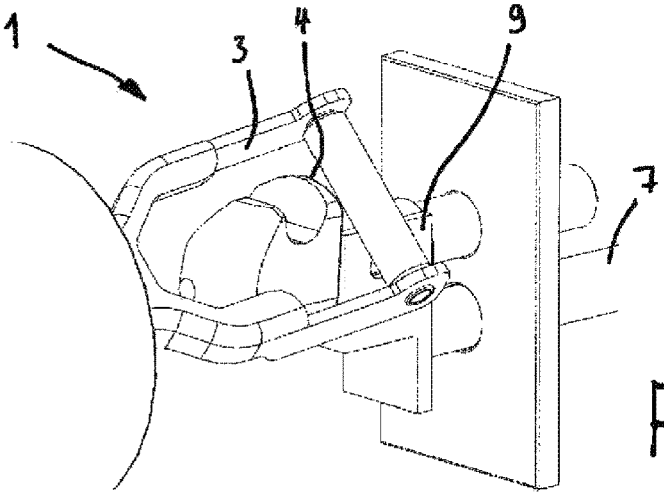
Figure 19:
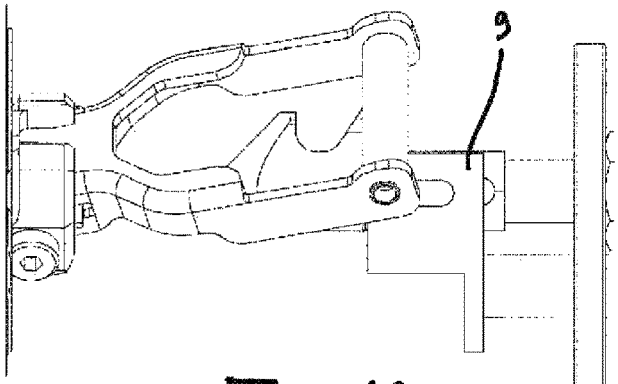

As can be seen in particular in FIGS. 7 and 8, the pivot element 8 is configured in the manner of a freely rotatable swiveling detent. The pivot element 8 has two legs 8.1, 8.2, which extend at an angle relative to one another, and a pivot axis S that is disposed between the legs 8.1, 8.2. In the release position of the lever support 5 illustrated in FIG. 7, the leg 8.1, which cooperates with the actuation element 7, assumes an essentially vertical position in which it is arrested via the actuation element 7, which rests against the back side of the leg 8.1 or against a contact piece 12 that is provided thereon. The leg 8.2, which extends at an angle relative to the leg 8.1, extends upwardly at an incline and with its upper side forms the lever support 5 that is necessary for the levering out or canceling of the latching.

By means of its essentially horizontally oriented pivot axis or shaft S, the pivot element 8 is coupled to one side of the pin-like closure element 2, so that the lever support 5 is movable from the release position illustrated in FIG. 7, in which position the lever support 5 is disposed in the region of the arresting structure 4, and into a latching position in which the lever support 5 is spaced from the bottom of the arresting structure 4.

To transfer the lever support 5 into the latching position, the rod-shaped actuation element 7 is withdrawn in the direction of the housing. As a consequence, the pivot element 8 assumes an unstable position, and begins, as a result of its own weight, to pivot into the latching position illustrated in FIGS. 15 and 16. During rotation of the closure element 3 relative to the pin-shaped first closure element 2, the latching portion 3.3 of the second closure element 3 does not pass into engagement with the lever support 5, so that it cannot tilt via the lever support 5 and cannot be raised out of the arresting structure 4. In this position, the securing mechanism 1 is secured from becoming unlatched, for example while cleaning processes are running in the interior of the device.

Figure 23:
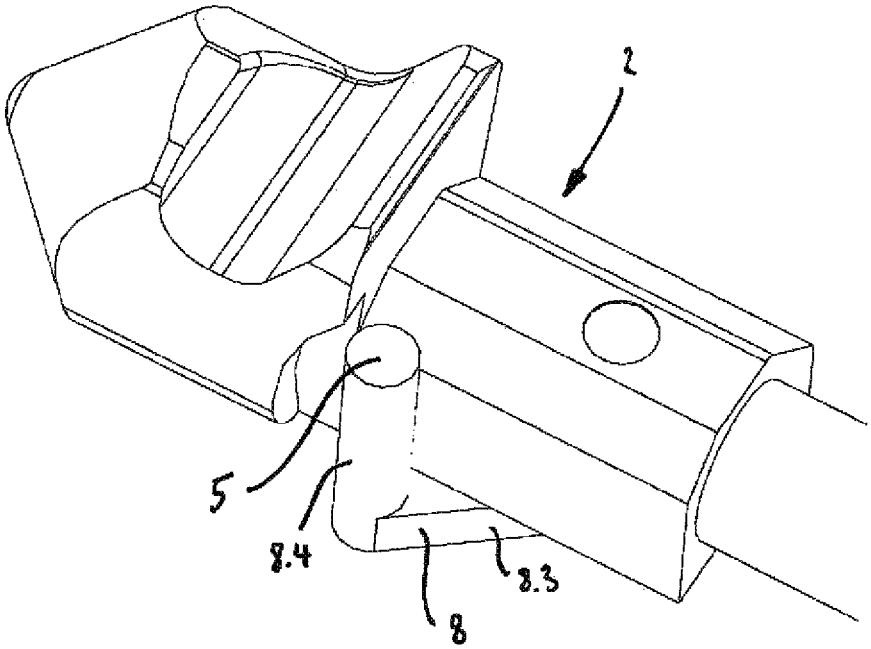
FIG. 23 is a view of a securing mechanism pursuant to a further exemplary embodiment in its release position.
Figure 24:
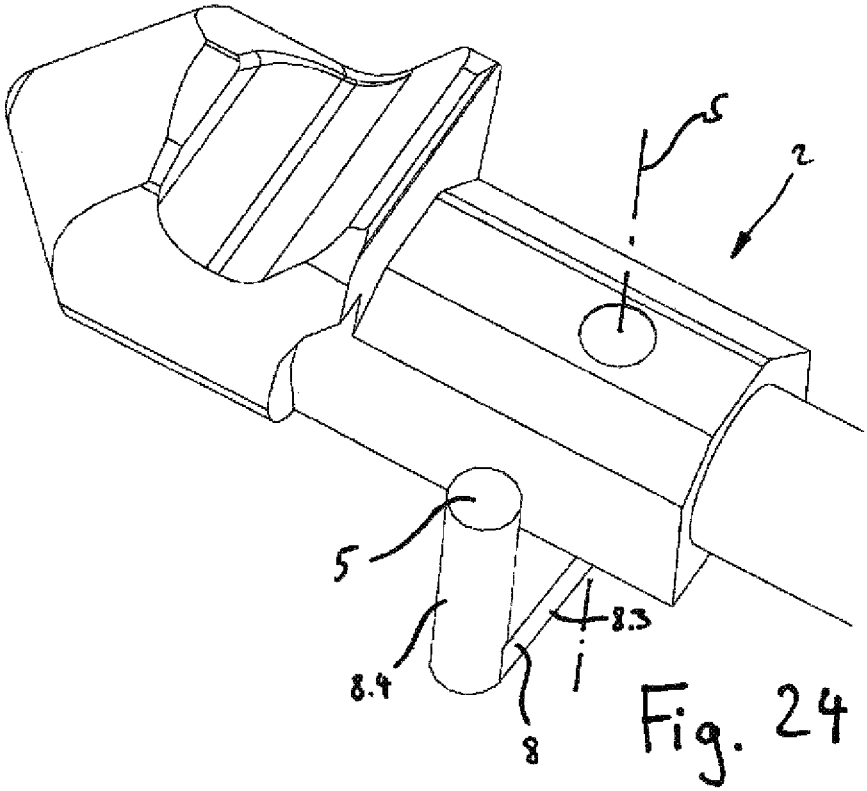
FIG. 24 is a view of the securing mechanism of FIG. 3 in its latching position.

FIGS. 23 and 24 show a configuration of the pivot element 8 where the pivot element is disposed on the first closure element 2 in such a way as to be pivotable over an essentially vertically extending axis S. With the embodiment of FIGS. 23 and 24, the pivot element 8 is disposed on the underside of the closure element 2, and is comprised of a leg 8.3 as well as a raised portion 8.4 that is provided on this leg and that extends into the region of the upper side of the closure element 2. On its upper side, the raised portion 8.4 forms the actual lever support 5, which in FIG. 3 is illustrated in its release position, and in FIG. 24 is illustrated in its latching position. Alternatively, it would also be conceivable to dispose a pivot element 8 on the upper side of the closure element 2. It would furthermore be conceivable to configure the pivot element 8 in such a way that two horizontal legs are provided, with a leg that is provided below the closure element 2 cooperating with the actuation element 7, and a leg provided above the closure element 2 forming the actual lever support 5.

An alternative configuration of the additional element that is actuated via the actuation element 7 is illustrated in FIGS. 17 to 22. With this embodiment, the additional element is not formed by a pivot element, but rather by a slide element 9, which is movable by the actuation element 7 from its latching position into the release position illustrated in FIGS. 17 to 19. Sliding of the slide element 9 in the direction of its release position is effected against the force of a spring that tensions it, and that upon withdrawal of the actuation element 7 is relaxed; in this manner, the slide element 9 automatically moves back into its latching position.

Figure 22:
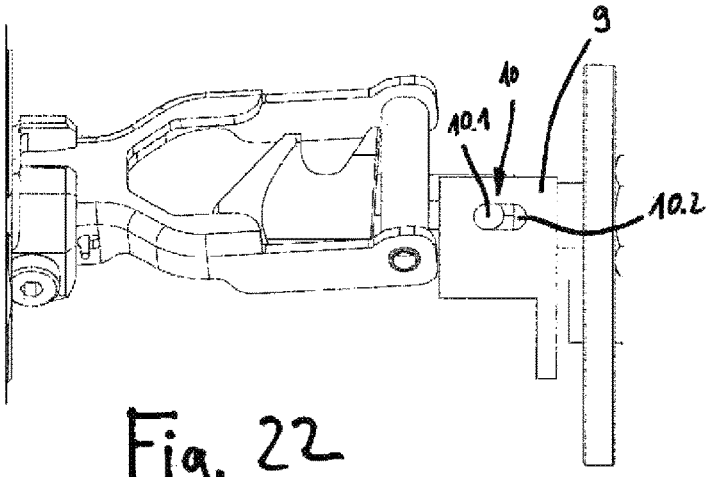

The slide element 9 is slidably disposed on the first closure element 2, whereby the movements of the slide element 9 are guided via an axial guide 10 that is formed of a pin/slot guide, whereby a fixed pin 10.1 engages in a slot 10.2 provided on the slide element 9; see FIG. 22.

Figure 20:
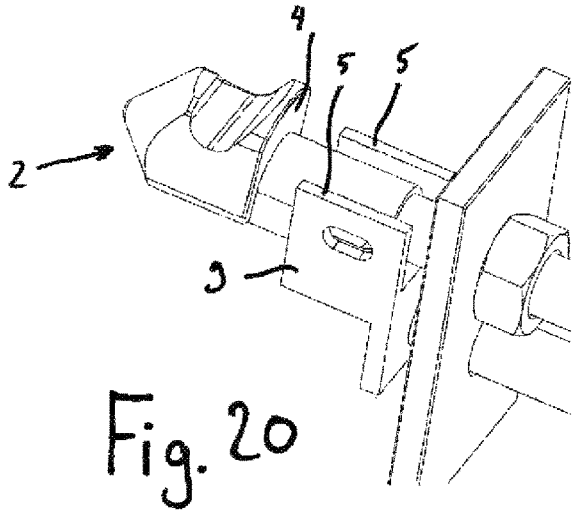
FIGS. 20-22 are views of the closure mechanism of the illustrations in FIGS. 17 to 19, with the lever support being disposed in its latching position.
Figure 21:
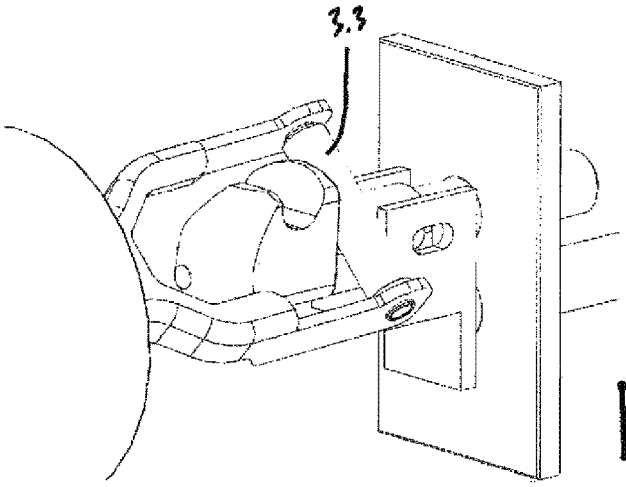

In contrast to the first embodiment, where the lever support 5 is disposed on the pivot element 8, the slide element 9 forms a double lever support having two lever supports 5 disposed on both sides of the first closure element 2; see FIG. 20. Hence, rotations to the left as well as to the right lead to a levering out of the latching portion 3.3 of the second closure element 3 out of the arresting structure 4. Just such an embodiment as a double lever support is, however, also conceivable with the first embodiment, whereby a pivot element 8 that is embodied in the manner of a double detent having lever supports disposed on both sides of the closure element 2 is utilized.

Figure 25:
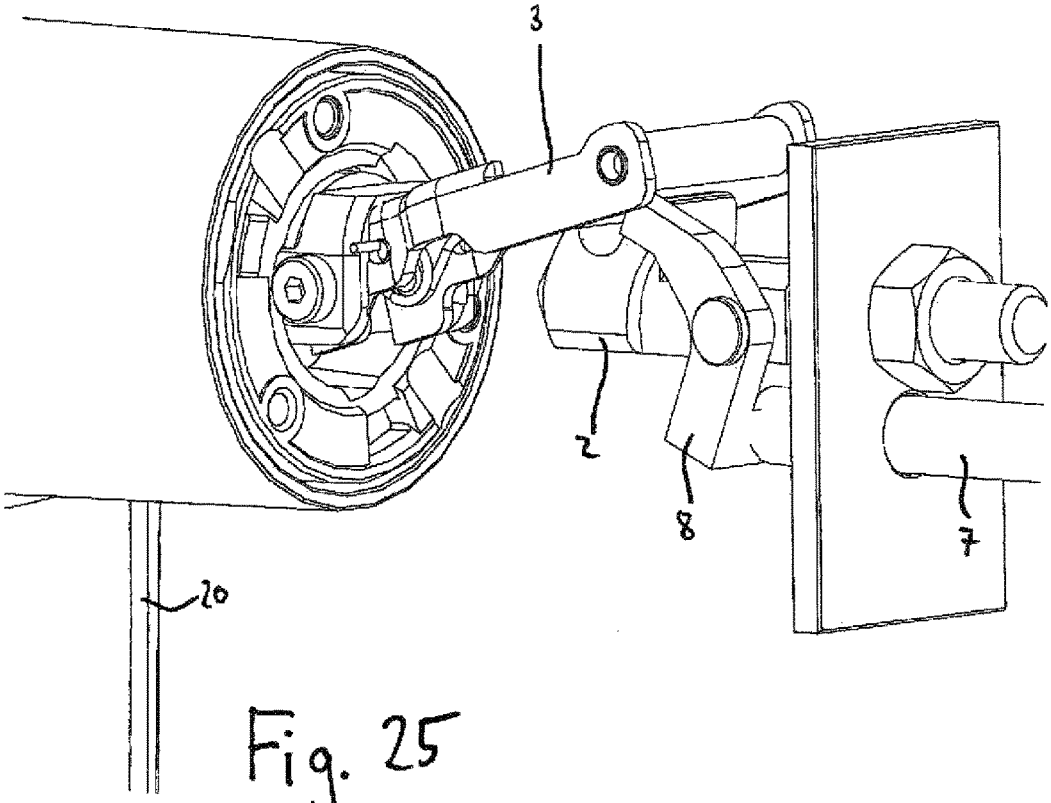
FIG. 25 is a view of a securing mechanism according to illustrations in FIGS. 1 to 16 to illustrate an open position.
Figure 26:
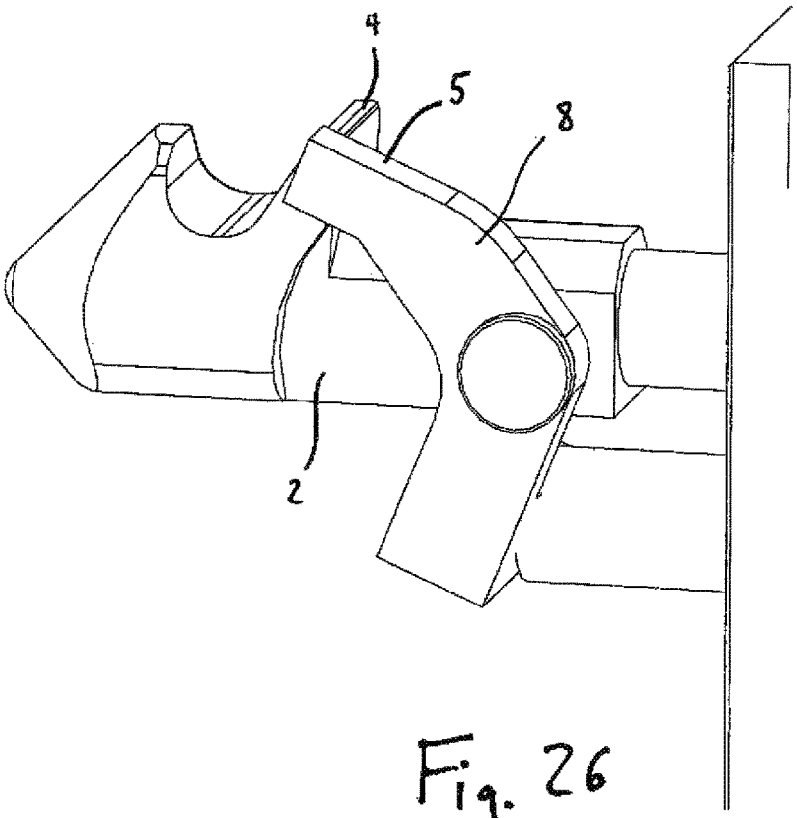
FIG. 26 is a further view of the securing mechanism of FIG. 25.

As shown in FIGS. 25 and 26, the lever support 5 can be movable back and forth not only between a latching position and a release position. These illustrations, which are based on the embodiment of FIGS. 1 to 16, shows that the lever support 5 can also be transferred into an open position in which the arresting structure 4 and the second closure element 3 are also released without actuating the actuation handle 20. The closure element 3 is raised by the lever support 5 into a position above the arresting structure 4, so that upon reaching the open position, the door automatically bursts open via the closing force applied by the door seal onto the two closure elements 2, 3 in the open position. With time-controlled baking processes, the open position can, for example, be utilized as an automatic opening mechanism for the precise ending of the baking process. Also for the embodiment having a slide element 9, the lever support 5 can be transferred into such an open position. For this purpose it is, for example, conceivable to provide a ramp-like edge on the upper side of the slide element 9.

The above described securing mechanism 1 is characterized by a relatively straightforward construction that permits controlled access. By means of the dual movability of the lever support 5 not only relative to the first closure element 2 but also to the second closure element 3, the lever support can be moved back and forth with little effort between its release position and its latching position, so that for the purpose of controlling access, relatively small drives can be used. The lever support 5 can be disposed in such a way that it is movable away from a load path that is produced by the closing force of the door seal and that extends over the first and second closure elements 2, 3, resulting in an easy movability.

Since the actuation element 7 is additionally spaced relatively greatly relative to that region of the arresting structure 4 that is often difficult to access from the outside, in emergency situations the latching can also be manually released, for example in such situations in which the drive of the actuation element 7 fails, or its power supply is interrupted. For this purpose, a sharp object can be laterally introduced into the region of the actuation element 7, and by applying pressure upon the pivot element 8 or the slide element 9, the lever support 5 can be brought into the release position and the door can be opened.

The specification incorporates by reference the disclosure of German 10 2011 051 884.3 filed Jul. 15, 2011, as well as International application PCT/DE2012/100210 filed Jul. 11, 2012. The present invention is, of course, in no way restricted to the specific disclosure of the specification and drawings, but also encompasses any modifications within the scope of the appended claims.

REFERENCE NUMERALS

1 Closure, securing mechanism, or lock
2 Closure element
2.1 Threaded portion
2.2 Inclined portion
2.3 Inclined portion
3 Closure element
3.1 Leg
3.2 Leg
3.3 Latching portion
4 Locking or arresting structure
5 Lever support
6 Locking or arresting structure
7 Actuation element
8 Pivot element
8.1 Leg
8.2 Leg
8.3 Leg
8.4 Raised portion
9 Slide Element
10 Axial guide

10.1 Pin
10.2 Slot
11 Spring
12 Contact piece
20 Actuation handle
21 Housing
5 Pivot axis or shaft

The invention claimed is:

1. A securing mechanism for a door, the securing mechanism comprising:

a first closure element (2);

an arresting structure (4) disposed on said first closure element (2), a second closure element (3) having a latching portion (3.3) for latching with said arresting structure (4), wherein for unlatching purposes, said second closure element (3) is rotatable relative to said first closure element (2) and said arresting structure; and a lever support (5) that is movable relative to said first closure element (2), wherein said lever support (5) is adjustable between a release position, in which, as a consequence of a rotation of said latching portion relative to said first closure element (2), said latching portion strikes said lever support (5) and said lever support deflects said latching portion (3.3) out from said arresting structure (4) so that said latching portion glides over and past said arresting structure, and a latching position, in which, during a rotation of said latching portion relative to said first closure element, said lever support is removed from a rotational range of said latching portion so that said latching portion does not contact said lever support and cannot pass over the arresting structure, so that latching between the first closure element and the second closure element is not released.

2. A securing mechanism according to claim 1, which further includes an actuation element (7), wherein said lever support (5) is movable between the release position and the latching position by means of said actuation element (7).

3. A securing mechanism according to claim 2, which further comprises a pivot element (8) that is configured to be pivotable via said actuation element (7), wherein said lever support (5) is disposed on said pivot element (8).

4. A securing mechanism according to claim 3, wherein said pivot element (8) is configured to be pressed into the release position, and to be arrested in this position, via said actuation element (7).

5. A securing mechanism according to claim 4, wherein said actuation element (7) is adapted to be retracted away from said second closure element, and wherein after retraction of said actuation element (7) away from said second closure element, said pivot element (8) is configured to be freely pivotable.

6. A securing mechanism according to claim 3, wherein said pivot element (8) is configured as a freely rotatable swiveling detent.

7. A securing mechanism according to claim 3, wherein said pivot element (8) is pivotably mounted on said first closure element (2), or wherein a pivot axis (S) of said pivot element (8) extends transverse to a direction of said arresting structure (4).

8. A securing mechanism according to claim 7, wherein if said pivot element (8) is pivotably mounted on said first closure element (2), said pivot axis (S) of said pivot element (8) extends parallel to the direction of said arresting structure (4), or wherein if said pivot axis (S) of said pivot element (8) extends transverse to the direction of said arresting structure (4), said pivot element (8) is disposed on an underside or an upper side of said first closure element (2).

9. A securing mechanism according to claim 3, wherein said pivot element (8) is disposed on a side surface of said first closure element (2).

10. A securing mechanism according to claim 2, which further comprises a slide element (9) that is displaceable via said actuation element (7), and wherein said lever support (5) is disposed on said slide element (9).

11. A securing mechanism according to claim 10, wherein said slide element (9) is configured to be pressed into the release position, and to be arrested in this position, via said actuation element (7).

12. A securing mechanism according to claim 11, which includes a spring, wherein said slide element (9) is biased in the direction of the latching position of said lever support (5), or wherein said actuation element (7) is coupled with said slide element (9) in a pressing and pulling manner.

13. A securing mechanism according to claim 10, wherein said slide element (9) is disposed on said first closure element (2) so as to be axially movable.

14. A securing mechanism according to claim 13, which includes an axial guide (10), wherein movements of said slide element (9) are guided via said axial guide.

15. A securing mechanism according to claim 10, wherein said slide element (9) is provided with said lever support (5) on a side of said first closure element (2), and a second lever support (5) on an opposite side of said first closure element (2).

16. A securing mechanism according to claim 2, wherein said first closure element (2) is embodied as a locking or closing pin.

17. A securing mechanism according to claim 16, wherein said actuation element (7) extends parallel to an axis of said first closure element (2).

18. A securing mechanism according to claim 1, wherein said second closure element (3) is embodied as a spring element that is biased in a direction of said arresting structure (4), or wherein said second closure element (3) is embodied as a spring element that is biased in the direction of said arresting structure (4) and is further embodied as a resilient, U-shaped member having two spring legs (3.1, 3.2) and a latching portion (3.3) that extends between said spring legs (3.1, 3.2), and wherein said latching portion (3.3) is configured to be latched in said arresting structure (4).

19. A securing mechanism according to claim 1, wherein said lever support (5) is movable from the release position into an open position in which the latching with said arresting structure (4) can be canceled independent of a rotational position of said first and second closure elements (2,3).

20. A securing mechanism according to claim 1, further comprising an actuation handle (20), wherein said second closure element (3) is rotatable via said actuation handle (20), and wherein said first closure element (2) has a stationary configuration.

* * * * *